US008708174B2

(12) United States Patent
Itzek

(10) Patent No.: US 8,708,174 B2
(45) Date of Patent: Apr. 29, 2014

(54) BOTTLE TEAT

(75) Inventor: Eckhard Itzek, Gyhum-Nartum (DE)

(73) Assignee: MAPA GmbH, Zeven (DE)

( * ) Notice: Subject to any disclaimer, the term of this patent is extended or adjusted under 35 U.S.C. 154(b) by 0 days.

(21) Appl. No.: 13/411,078

(22) Filed: Mar. 2, 2012

(65) Prior Publication Data

US 2013/0056435 A1 Mar. 7, 2013

(30) Foreign Application Priority Data

Mar. 4, 2011 (DE) ..... 10 2011 013 080

(51) Int. Cl.

| | |
|---|---|
| ***A61J 11/00*** | (2006.01) |
| ***A61J 9/00*** | (2006.01) |
| *A61J 9/04* | (2006.01) |
| *A61J 11/02* | (2006.01) |

(52) U.S. Cl.

CPC ..... *A61J 9/00* (2013.01); *A61J 9/04* (2013.01); *A61J 11/00* (2013.01); *A61J 11/02* (2013.01)

USPC ..... 215/11.5; 215/11.1; 215/11.4; 215/11.6; 215/276

(58) Field of Classification Search

USPC ..... 215/11.1, 11.4, 11.5, 11.6, 276

See application file for complete search history.

(56) References Cited

U.S. PATENT DOCUMENTS

| | | | | |
|---|---|---|---|---|
| 6,343,704 | B1 * | 2/2002 | Prentiss | 215/11.1 |
| 2003/0106872 | A1 | 6/2003 | Lin | |
| 2005/0252875 | A1 * | 11/2005 | Sheu et al. | 215/11.5 |
| 2007/0102388 | A1 | 5/2007 | Lewis et al. | |
| 2009/0039046 | A1 * | 2/2009 | Marr et al. | 215/11.4 |

FOREIGN PATENT DOCUMENTS

| | | | |
|---|---|---|---|
| DE | 197 39 911 | A1 | 6/1998 |
| DE | 299 06 849 | U1 | 8/1999 |
| DE | 202 04 357 | U1 | 9/2002 |
| DE | 10 2005 006 768 | A1 | 8/2006 |
| WO | 2006/103379 | A1 | 10/2006 |
| WO | 2009/087077 | A1 | 7/2009 |

* cited by examiner

*Primary Examiner* — Anthony Stashick
*Assistant Examiner* — Elizabeth Volz
(74) *Attorney, Agent, or Firm* — Vidas, Arrett & Steinkraus

(57) ABSTRACT

A bottle teat comprising:

A nipple sleeve having a hollow nipple and a through-hole connected at the bottom to a hollow nipple sleeve which is connected at the bottom to a nipple flange that is connected to the nipple sleeve to be fastened to a bottle by a fastening ring which serves at the bottom with an annular disc-shaped ring flange overlapping the nipple flange, A contact area projecting downward or upward from the nipple flange, or from the nipple sleeve above the nipple flange outward into the area for placing a ring flange, and A lip valve that is opened when the nipple flange is not fastened to a bottle arranged in a deforming area next to the contact area so that the deformation of the nipple flange that arises from pressing the fastening ring against the contact area closes the valve.

16 Claims, 7 Drawing Sheets

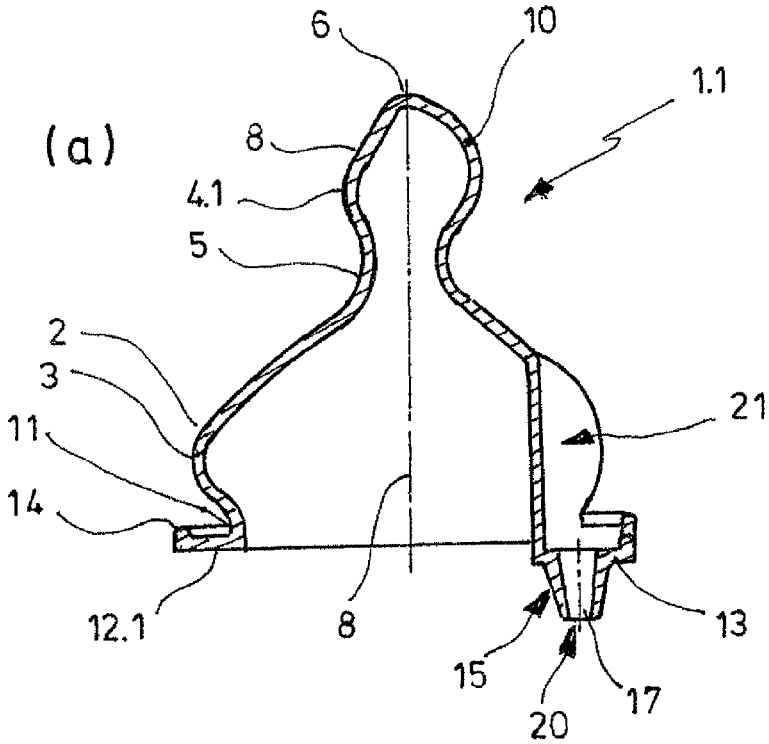
FIG.1
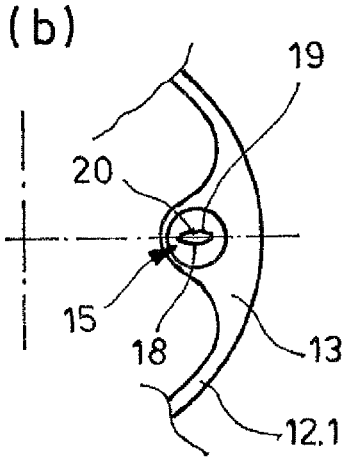
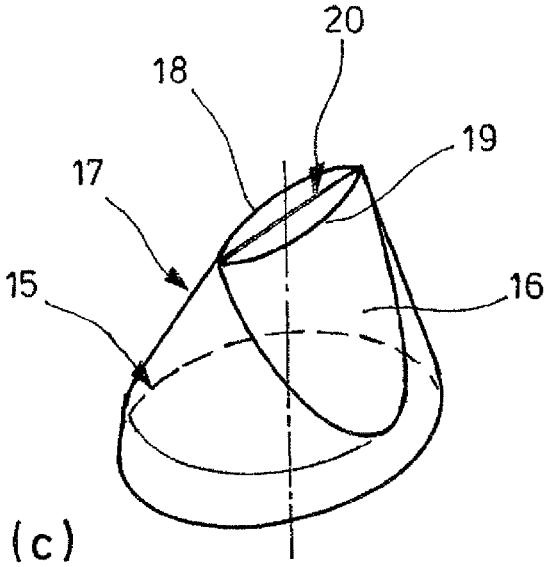

BOTTLE TEAT

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The invention relates to a bottle teat, especially for infants and small children.

Bottle teats are used to administer milk and other liquid nutrition, especially to infants and small children. Bottle teats have a hollow nipple with a through-hole for liquid nutrition. The nipple is connected at the bottom as a single part to a hollow nipple sleeve. At the bottom, the nipple sleeve has an annular nipple flange. The cross-section of the nipple is tailored to the mouth of a child. In the area of the nipple sleeve, the cross-section expands toward the nipple flange to the cross-section of a fastening edge of a bottle. The nipple is fastened by means of a fastening ring to the fastening edge of the bottle. The fastening ring has a cylindrical cover with fastening means to be fastened to the fastening means of a bottle. Frequently, the fastening means are threads on the inner circumference of the cover and on the outer cover of the bottle. Furthermore, the fastening ring has a downward-projecting, annular-disc-shaped ring flange that overlaps the nipple flange and presses against the fastening edge of the bottle. In response to suction, a vacuum arises in the bottle that makes it difficult to withdraw the liquid. The bottle teat can collapse from the vacuum, causing the nipple to slip into the bottle. To prevent this, bottle teats have a ventilation valve. The ventilation valve opens when a certain vacuum predominates in the bottle. This causes the pressure to adjust to the surroundings.

DE 197 39 911 C5, the entire contents of which is incorporated herein by reference, describes a bottle teat of the aforementioned type and the fastening of the bottle teat by means of a threaded ring to a bottle. With this bottle teat, the ventilation valve is a slot valve that is arranged in a recess in a side of the sleeve.

WO 2009/087077, the entire contents of which is incorporated herein by reference, A1 describes a bottle teat having a plurality of drinking slits that are arranged in the sides of an imaginary polygon. The vent valve of this bottle teat is a slot valve arranged in a recess. The bottle teat is made of a soft elastic material.

According to one embodiment, this is natural rubber, or silicone, or a thermoplastic elastomer (TPE). The bottle teat can for example be made by dipping a molded body in a latex suspension, or by injection molding and subsequently incorporating the slots by means of knives.

DE 299 06 849 U1, the entire contents of which is incorporated herein by reference, describes another bottle teat having a ventilation valve in a recess in the side of the sleeve. The recess has substantially flat, opposing sidewalls that are connected to each other in the base of a recess across a narrow section in the wall. After the section is opened by means of a screwdriver, fork, etc., the side walls can be pressed against each other by the liquid in the bottle.

The known bottle slot valves are difficult to produce since they have to be provided with a slot in an additional production step. An additional disadvantage is that the sealing lips delimited by the slot only rest against each other with a slight amount of pressure; consequently, the lip valve opens when a vacuum is applied that can be less than the vacuum exerted by a child while nursing.

Furthermore, nipple teats are known with a ventilation valve between the nipple flange and threaded ring. DE 10 2005 006 768, the entire contents of which is incorporated herein by reference, A1 discloses such a bottle teat that, in the nipple flange, has a valve opening that narrows toward the ring flange of the threaded ring.

On the top side, the nipple flange has an annular elevation which engages in a groove in a peripheral, bottom base surface of the threaded ring. In the outer side, the nipple sleeve has a recess that extends to the nipple flange and forms a ventilation channel. The outer edge area of the nipple flange is clamped between the fastening edge and ring flange. Provided that a vacuum predominates in the bottle, the inner part of the nipple flange can move downward, causing the elevation to move away from the base of the groove. Consequently, the pressure can be equalized through the ventilation channel, the gap between the ring flange and nipple flange, and the valve opening.

This design is complicated to produce and difficult to clean. In addition, an axial force acting on the bottle teat can open the ventilation valve which prevents a vacuum from building in the bottle.

A similar design is known from US 2007/0102388, the entire contents of which are incorporated herein by reference.

Nipple teats with lip valves in the bottom side of a nipple flange are known from US 2005/0252875 A1, the entire contents of which is incorporated herein by reference, WO 2006/103379 A1, the entire contents of which is incorporated herein by reference, DE 202 04 357 U1, the entire contents of which is incorporated herein by reference, and US 2003/0106872 A1, the entire contents of which is incorporated herein by reference. These bottle teats are produced in an injection molding procedure. For production reasons, the sealing lips lie against each other without initial tension so that they can be easily opened by a vacuum. The pressure is equalized when the valve is opened through a gap between the top side of the nipple flange and the bottom side of the ring flange. When liquid lies against the side surfaces of the ventilation valve, they are pressed together and the liquid is prevented from exiting. The two last-cited documents describe bottled teats in which the lip valve is integrated in the wall of the nipple flange.

Against this background, an object of the invention is to create a bottle teat that is easy to produce and enables the opening pressure of the ventilation valve to be specified.

BRIEF SUMMARY OF THE INVENTION

The nipple teat according to the invention, especially for infants and small children, has:

- A nipple sleeve having a hollow nipple with at least one through-hole for liquid nutrition that is connected at the bottom to a hollow nipple sleeve which is connected at the bottom to a substantially annular disc-shaped nipple flange to be fastened to the fastening edge of a bottle by means of a fastening ring with a cylindrical cover by means of fastening means to be fastened to additional fastening means of the bottle and an annular disc-shaped ring flange overlapping the nipple flange,
- A contact area projecting downward or upward from the nipple flange, or from the nipple sleeve above the nipple flange outward into the area for placing a ring flange, and A lip valve that is opened when the nipple flange is not fastened to a bottle by means of a fastening ring, and that is arranged in the nipple flange or the nipple sleeve in a deforming area next to the contact area so that, when the nipple flange is fastened by means of the fastening ring to a bottle, the deformation of the deforming area that arises from pressing the fastening ring against the contact area closes the valve.

The bottle teat according to the invention has a lip valve that is arranged in the nipple flange or the nipple sleeve. The bottle teat is manufactured in such a manner that the lip valve is open. The lip valve is arranged in a deforming area next to a contact area of the bottle teat. The contact area projects downward or upward from the nipple flange, or outward from the nipple sleeve above the nipple flange. It is hence deformed by the fastening ring particularly when the bottle teat is fastened to a bottle. The deformation of the contact area affects the neighboring deforming area of the bottle teat in which the lip valve is arranged. The deformation of the deforming area closes the lip valve. The level of pressure between the sealing lips can be controlled by the design of the deforming area and the lip valve. It is accordingly possible to achieve a specific opening pressure. The nipple teat can be designed such that the opening pressure is independent of an axial force acting on the nipple teat. The nipple teat with the open lip valve can be easily manufactured by injection molding. The drinking slit does not have to be subsequently incorporated. The open lip valve makes it easier to completely clean the bottle teat after use.

According to one embodiment, the lip valve is arranged in the nipple flange at a distance from the outer edge of the nipple flange. The nipple flange can be affixed to the outer edge between the fastening edge and ring flange. The lip valve faces the opening in the bottle. The surrounding air can flow through a gap between the fastening ring and bottle teat to adjust the pressure.

According to another embodiment, the lip valve projects from the bottom side of the nipple flange. The lip valve can engage in the opening of the bottle.

According to another embodiment, the contact area is a bulge in the undeformed nipple flange in which the lip valve is arranged which is pressed flat between the fastening edge and ring flange when the nipple flange is mounted by means of a fastening ring on the bottle. The bottle teat is manufactured with an open lip valve in the area of the bulge. When the bulge is pressed flat, the lips of the lip valve lie against each other in a seal. The opening pressure can be controlled by the design of the bulge and the lip valve.

According to another embodiment, the nipple sleeve has an indentation that is above the lip valve and extends radially toward the nipple flange. The indentation makes it easier to produce the bottle teat with the lip valve in the nipple flange by means of a simple injection mold, the parts of which can be pulled apart perpendicular to a single parting plane. In addition, the indentation can serve to supply surrounding air to the lip valve.

According to another embodiment, the lip valve is arranged in the nipple sleeve and is the contact area of a bulge in the undeformed nipple flange below the lip valve which is pressed flat between the fastening edge and ring flange when the nipple flange is mounted by means of a fastening ring to a bottle. This bottle teat is also manufactured with a bulge in the undeformed nipple flange and with an open lip valve. However, the nipple valve is not arranged in the nipple flange but rather above the nipple flange in the nipple sleeve. When the nipple flange is clamped between the fastening edge and ring flange, the bulge is pressed flat, and this and this deformation closes the lip valve. The pressure between the lips of the lip valve depends on the design of the bulge and the lip valve and can be controlled thereby. To equalize the pressure, the surrounding air can flow into the lip valve directly from the side of the nipple sleeve.

According to another embodiment, the bulge in the undeformed nipple flange points downward. When the lip valve projects from the bottom side of the bulge with lips pointing radially toward the nipple flange, the lips are closed as the bulge is pressed flat. When the lip valve in the nipple sleeve is arranged with lips parallel to the nipple flange, the lops are also closed as the bulge is pressed flat.

According to another embodiment, the lip valve is arranged in the nipple sleeve, and the contact area is an outward-projecting bead in the nipple sleeve that is next to the lip valve and is arranged in the area assumed by the ring flange of the threaded ring when the threaded ring fixes the nipple flange to a bottle. This bottle teat is also manufactured with an open lip valve. When the bottle teat is fixed to the bottle by means of the fastening ring, the fastening ring presses against the outward-projecting bead. This causes the sealing lips of the lip valve to close. With a given fastening ring, the pressure between the sealing lips and the opening pressure can be controlled by the design of the bead.

According to an embodiment of the bottle teat that has a lip valve in the nipple sleeve, the lip valve is arranged radially in the nipple sleeve with reference to the nipple flange. With this embodiment, the lip valve is arranged in the nipple and does therefore not disturb during use.

According to another embodiment, the nipple sleeve has a constriction above the nipple flange. The constriction allows the fastening ring to be undetachably preinstalled on the bottle nipple and thereby makes handling easier. In addition, the nipple sleeve at least partially covers the fastening ring which creates a large, soft contact area for the mouth and chin of a child.

According to another embodiment, the lip valve is arranged above the constriction in an area above the nipple sleeve with a larger diameter. In this position, the lip valve does not impair the attachment of the bottle teat to the bottle by means of the fastening ring. Furthermore, the lip valve is distant from the contact area of the child's mouth and chin so that the equalization of pressure is unrestricted.

According to a preferred embodiment, the lip valve is arranged in the area of the nipple sleeve having the maximum diameter.

According to one embodiment, the bottle teat has a plug that projects from the through-hole for liquid nutrition, or the drinking hole. The plug is preferably designed as a single part with the nipple. The plug preferably consists of the same material as the nipple. It is also preferable for the plug to be integrally manufactured with the entire bottle teat. The bottle teat including the plug preferably consists of silicone or a thermoplastic elastomer, or a plastic that can be injection molded. The drinking hole is reliably sealed by the plug until first use. The plug forms a tamper-evident closure that the user can remove directly before use to expose the drinking hole. In addition, injection molding simplifies production since an injection mold does not require needles to delimit a drinking hole, which eliminates in particular the effort needed to service the mold that this causes.

According to one embodiment, the plug has a small handle. The handle makes it easier to remove the plug from the nipple, especially by twisting the plug out of the nipple.

According to another embodiment, the plug has a weakened area of material. The plug can be specifically separated along the weakened area of material. It is also preferable for the weakened area of material to be arranged inside the drinking hole. This makes it possible to disconnect the plug from the bottom nipple below the outer surface of the bottle nipple. The break edges of the disconnecting point therefore do not come into contact with the infant. To this end, the plug can be connected to the inner perimeter of the drinking hole.

According to another embodiment, the bottle teat is made of silicone or a thermoplastic elastomer, or another plastic that can be injection molded. According to a preferred embodiment, the bottle teat is injection molded.

However, it is generally possible to manufacture the bottle teat of latex in a dipping process. The lip valve can be subsequently cut if necessary. The opening pressure of the lip valve can be controlled by means of the invention.

Furthermore, the invention relates to a baby bottle with a nipple according to the invention that is mounted on a bottle by means of a fastening ring, wherein the fastening ring has fastening means on a cylindrical cover that interact with additional fastening means of the bottle to releasably fasten the fastening ring to the bottle, a ring flange of the fastening ring assumes an area around the nipple sleeve above the nipple flange, and the nipple flange is clamped between the fastening edge of the bottle and the ring flange of the fastening ring.

The designations "top" and "bottom" in this application refer to an arrangement of the bottle teat on the top of the fastening edge of a vertically aligned bottle, whereas the nipple is arranged at the top, and the base of the bottle is arranged at the bottom.

The invention is explained in more detail hereinafter with reference to the accompanying drawings of exemplary embodiments. The drawings show the following:

BRIEF DESCRIPTION OF THE SEVERAL VIEWS OF THE DRAWINGS

FIG. 1*a-e* A vertical section of the lip valve of a nipple teat with a lip valve in a nipple flange in an undeformed state (FIG. 1*a*), a partial section from below of the nipple flange with an open lip valve (FIG. 1*b*), an enlarged perspective, detailed view of the open lip valve at an angle from below (FIG. 1*c*), a side view of the nipple teat in an undeformed state (FIG. 1*d*), and the same side view of the bottle teat with the lip valve in a closed state (FIG. 1*e*);

DETAILED DESCRIPTION OF THE INVENTION

Figure 1D:
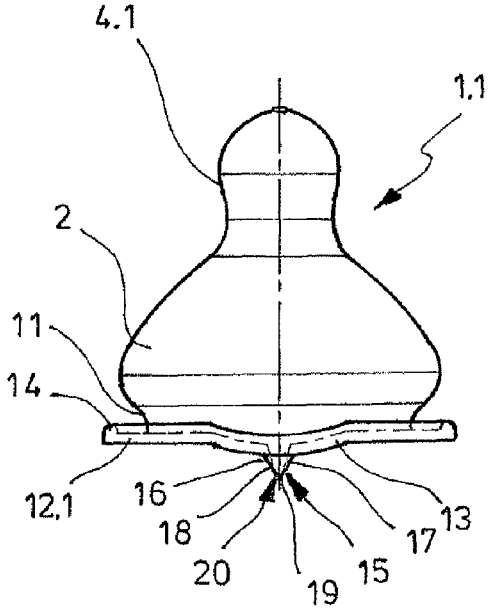

While this invention may be embodied in many different forms, there are described in detail herein a specific preferred embodiment of the invention. This description is an exemplification of the principles of the invention and is not intended to limit the invention to the particular embodiment illustrated In the following explanation of different exemplary embodiments, the corresponding, or substantially corresponding, elements are provided with the same reference numbers.

According to FIG. 1, a bottle teat 1 has a bellows-like nipple sleeve 2 that narrows upward from the largest diameter 3. At the top, the nipple sleeve 2 bears a nipple 4 that has a nipple neck 5 and a nipple head 6. In one side, the nipple head 6 is provided with a vent 9 at an angle to the mid-axis 8 of the bottle teat 1.1. It has at least one drinking hole 10 on the opposite side.

At the bottom, the nipple sleeve 2 has a constriction 11. At the bottom end of the constriction 11, the nipple sleeve 2 is connected to a nipple flange 12.1 projecting radially outward that concentrically surrounds the mid-axis 8. The nipple flange 12. is substantially flat but has a downward-projecting bulge 13.1 in a section of its perimeter. In addition, the nipple flange 12 has a peripheral, vertically projecting edge bead 14 on the outer edge. At the lowest point of its bulge 13, the nipple flange 12.1 has a downward projecting lip valve 15.

According to FIG. 1*b*, the nipple flange 12.1 extends inward in the area of the lip of valve 15.

According to FIG. 1*c*, the lip valve 15.1 is substantially funnel-shaped with two flat sidewalls 16, 17. The bottom edge of the sidewalls 16, 17 forms lips 18, 19 of the lip valve 15. The bottle teat 1.1 is manufactured in such a manner that the lip valve is open in an undeformed state. A lens-shaped valve opening 20 is between the lips 18, 19. The lips 18, 19 are aligned radially to the nipple flange 12. Bottle teat 1.1 is shown in FIG. 1*d*.

Above the lip valve 15.1, the nipple sleeve 2 has an indentation 21 pointing radially inward.

Figure 1E:
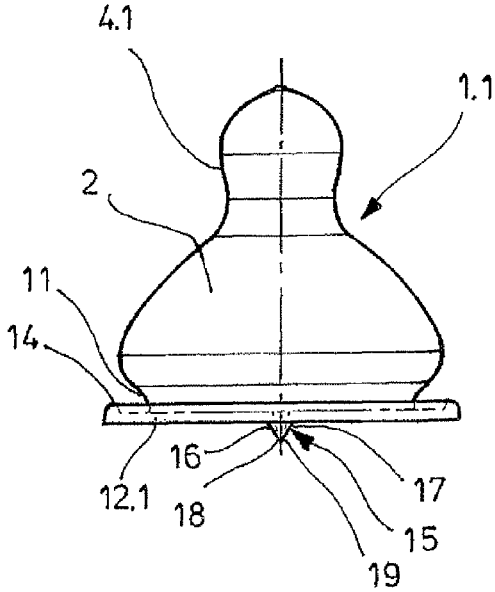

When the bulge 13 of the nipple flange 12.1 is flattened, it affects the lip of valve 15.1 such that the lips 18, 19 abut each other and close the valve opening 20. This is shown in FIG. 1*e*.

Figure 2:
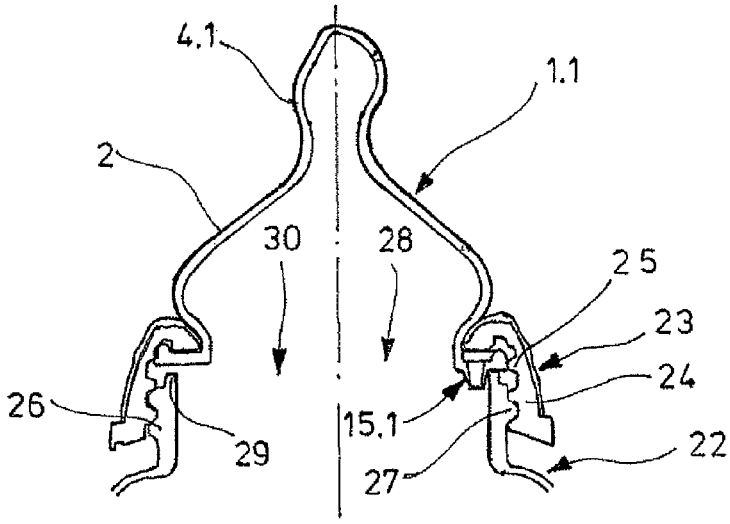
FIG. 2 A vertical section of the lip valve of the same bottle teat fastened by means of a fastening ring to a fastening edge of a bottle.

According to FIG. 2, the bottle teat 1.1 is affixed to a bottle 22 by means of a fastening ring 23. On the inner perimeter of its approximately cylindrical cover 24, the fastening ring 23 has an inner thread 25, and on the outer perimeter of its neck 26, the bottle 22 has an outer thread 27 so that the fastening ring 23 can be screwed onto the bottle 22. Projecting inward from the top edge of the fastening ring 23 is a ring flange 26 that is substantially shaped like an annular disc.

The nipple sleeve 2 of the bottle teat 1.1 extends through a central opening 28 of the fastening ring 23 to place the ring flange 28 directly above the top side of the nipple flange 12.1. When the bottle teat 1.1 is screwed tight by means of the fastening ring 23, the bottom side of the nipple flange 12.1 is pressed against the fastening edge 29 of the bottle 22 that runs around the opening 30 of the bottle 22. This presses the bulge 13 flat and the lip valve 15.1 engaging in the opening 28 closes.

When suction is applied to the bottle teat 1.1, a vacuum arises in the bottle 22. When the vacuum exceeds the opening pressure of the lip valve 15, air flows through the gap between the fastening ring 23 and the top side of the nipple flange 12.1. This prevents the bottle teat 1.1 from collapsing and keeps the child from having to exert excessive suction.

Figure 3:
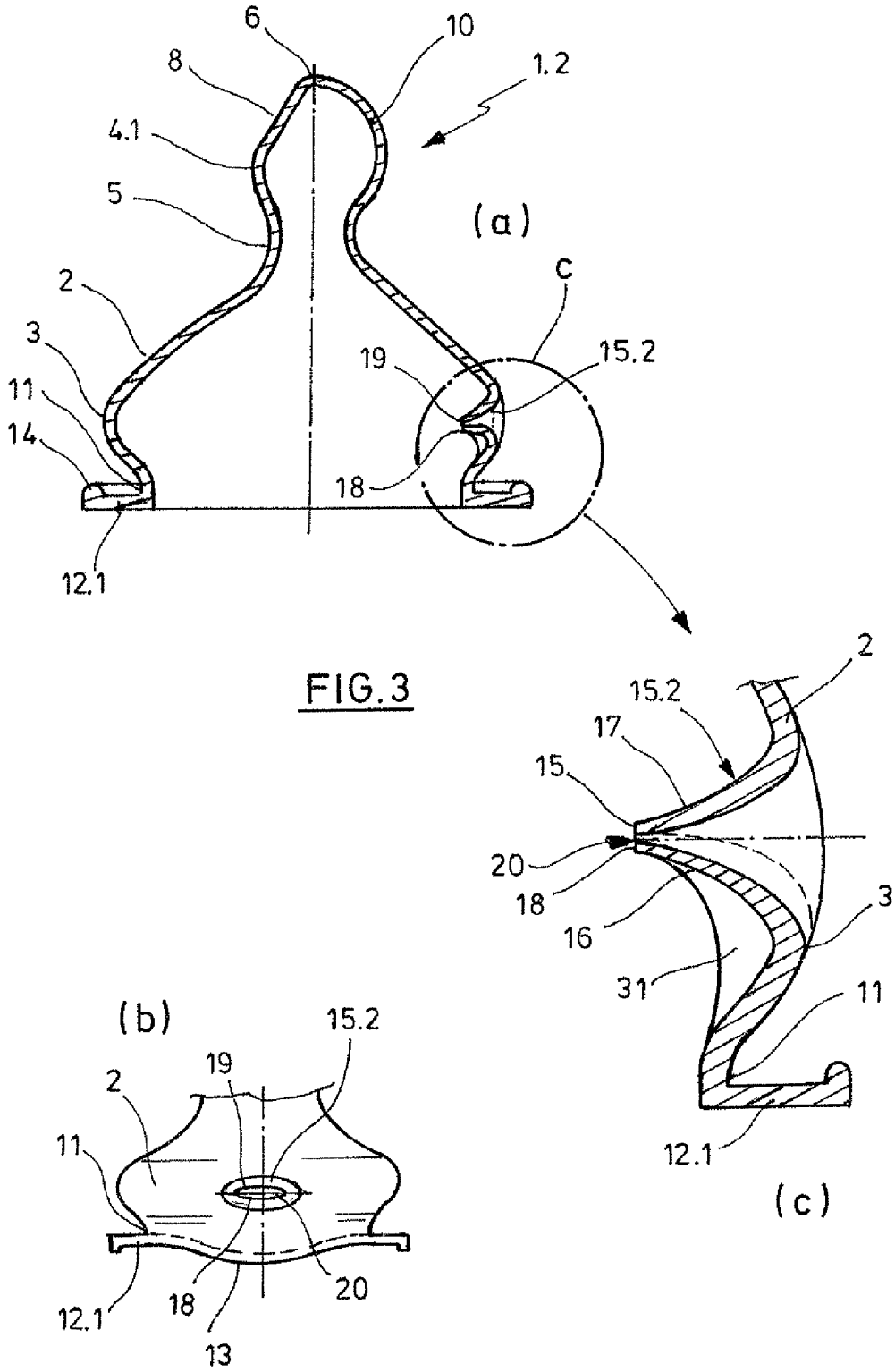
FIG. 3*a-c* A bottle teat with a bulge in the nipple flange and a lip valve arranged there above in the nipple sleeve in an open state with a vertical section of the lip valve (FIG. 3*a*), a partial front view (FIG. 3*b*) and with an enlarged detail c from FIG. 3*a* (FIG. 3*c*)

The bottle teat 1.2 in FIG. 3 differs from bottle teat 1.1 in that the nipple valve 15.2 is arranged in the nipple sleeve 2 above the bulge 13. The lip valve 15.2 is arranged in the area of the maximum diameter of the nipples leave 2. In this design, the bottom lip 18 is stabilized by a bar 31 that is arranged radially with reference to the nipple flange 12.1 on the inside of the nipple sleeve 2. The bar 31 is connected to the inside of the bottom side wall 16 and the neighboring area of the nipple sleeve 2. It is arranged vertically with reference to the nipple flange 12.1. The lips 18, 19 are aligned horizontally and parallel to the nipple flange 12.1.

The lip valve 15.2 forms a funnel-shaped recess in the area of the maximum outer diameter of the nipple sleeve 2.

When the bottle teat 1.2 is in an undeformed state, the lips 18, 19 are open. This is shown in FIG. 3*c*. When bottle teat 1.2 is fixed like bottle teat 1.1 in FIG. 2 to a bottle 22 by means of a fastening ring 23, the bulge 13 is pressed flat. This deformation of the bottle teat 1.2 acts on the lip valve 15.2 in such a manner that the lips 18, 19 are pressed together with a specific surface pressure. Consequently, the pressure is equalized with the surroundings when a specific vacuum is exceeded in the bottle 12.

Figure 4A:
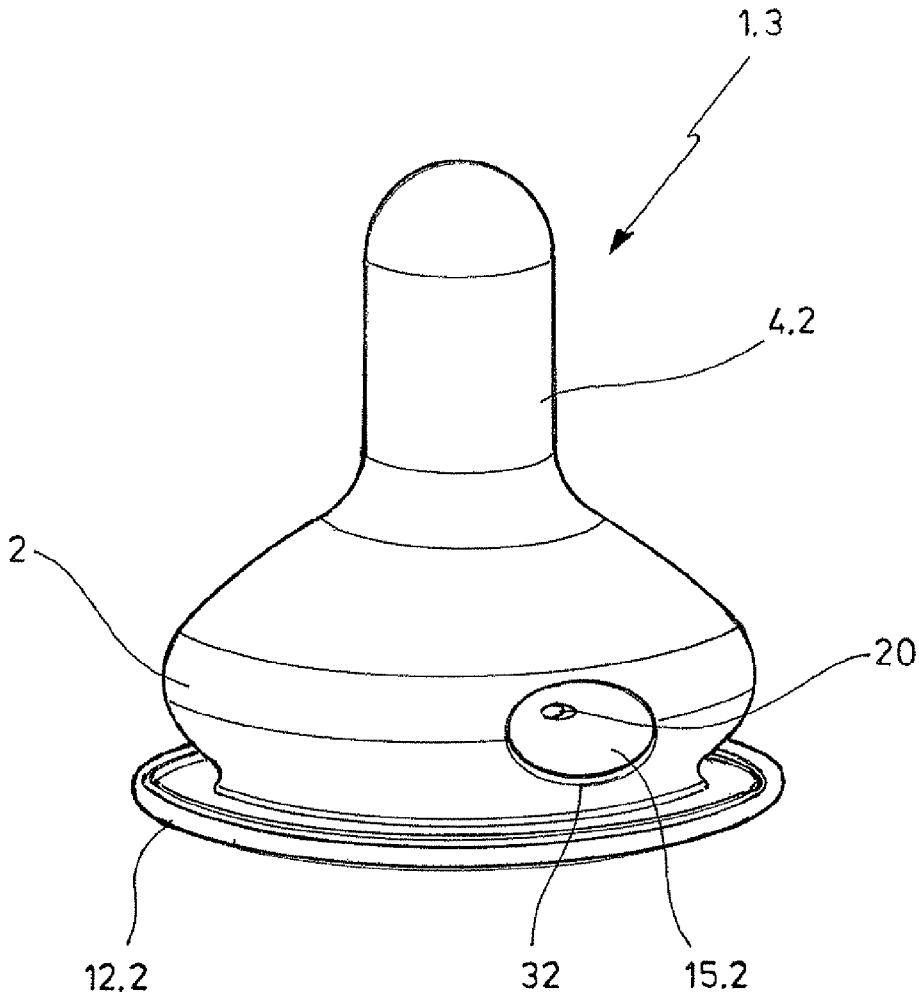
FIG. 4*a-c* A bottle teat with a lip valve in a nipple sleeve and a neighboring bead with a perspective view (FIG. 4*a*), a front view (FIG. 4*b*) and a vertical section of the lip valve (FIG. 4*c*)
Figure 4B:
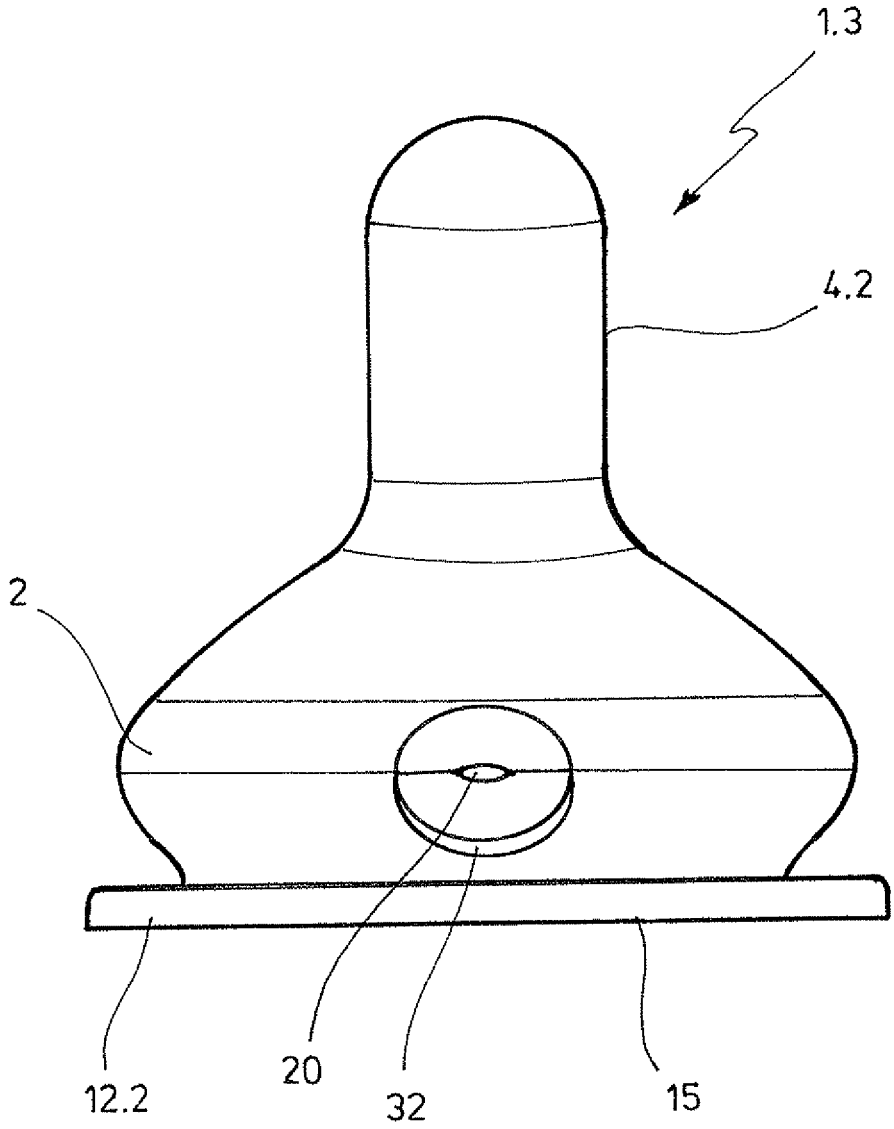
Figure 4C:
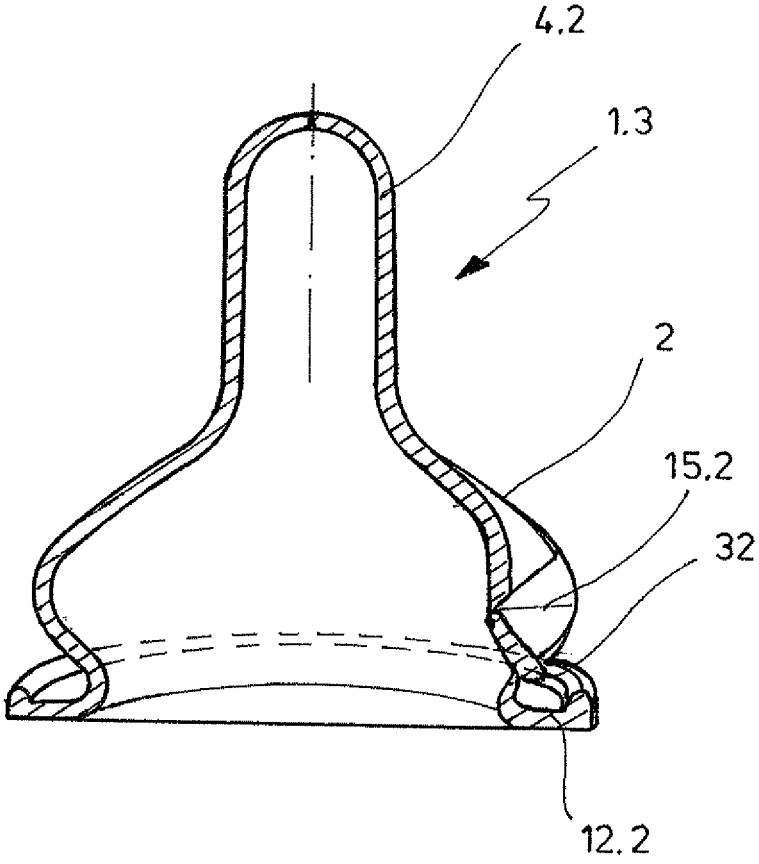

The bottle teat 1.3 in FIG. 4 differs from bottle teat 1.2 especially in that the nipple flange 12.2 does not have a bulge in an undeformed state. A bead 32 is in the bottom edge of the funnel-shaped opening of the lip valve 15.2. In the example, the bead 32 is in the shape of a crescent. In addition, the nipple 4.2 is cone-shaped with a dome-shaped end.

With bottle teat 1.3, the lip valve 15.2 is open in an undeformed state. When bottle teat 1.3 is attached to a bottle 22 by means of a fastening ring 23, the ring flange 26 of the fastening ring 23 presses against the bead 32. The lip valve 15.2 is thereby deformed such that the lips 18, 19 contact each other with a specific surface pressure, and the opening 20 is closed.

When a specific vacuum in the bottle 1.3 is exceeded, the lip valve 15.2 opens, and the pressure is equalized.

Figure 5:
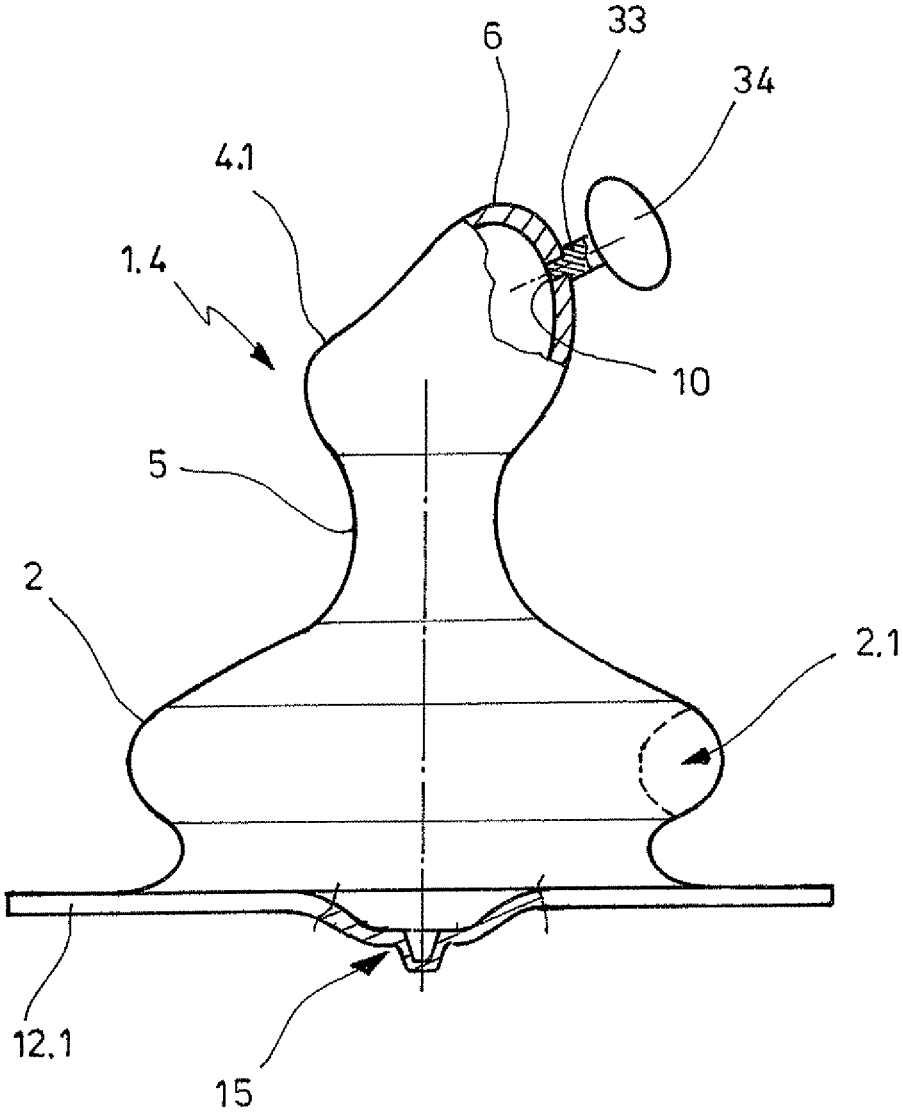
FIG. 5 A side view of a bottle teat having a lip valve and tamper-evidence closure.

The bottle teat 1.4 in FIG. 5 differs from the bottle teat in FIG. 1 in that the lip valve 15 is offset 90° on the nipple flange 12.1.

Furthermore, the drinking hole 10 is sealed by a plug 33 formed as a single part with and from the same material as the nipple 5. The plug 33 is integrally formed with the entire bottle teat 1.4. The plug 33 is connected to the wall of the nipple at the edge of the drinking hole 10. It has a handle 34. The handle 34 makes it easier to twist off the plug 33 to open the drinking hole 10.

This completes the description of the preferred and alternate embodiments of the invention. Those skilled in the art may recognize other equivalents to the specific embodiment described herein which equivalents are intended to be encompassed by the claims attached hereto.

What is claimed is:

1. A bottle teat in particular for infants and small children comprising:

a nipple sleeve having a hollow nipple (4) with at least one through-hole (10) for liquid nutrition that is connected at the bottom to a hollow nipple sleeve (2) which is connected at the bottom to a substantially annular disc-shaped nipple flange (12) that is connected to the nipple sleeve (2) to be fastened to a fastening edge (29) of a bottle (22) by means of a fastening ring (23) which serves at the bottom with an annular disc-shaped ring flange (26) overlapping the nipple flange (12), a contact area (13, 31) projecting outward from the nipple sleeve (2) above the nipple flange (12) into the area for placing the ring flange (26), a lip valve (15) that is open when the nipple flange (12) is not fastened to said bottle (22) and is arranged in a deforming area next to the contact area (13, 31) so that, when the nipple flange (12) is attached to said bottle (22) by means of said fastening ring (23), the deformation of the nipple flange (12) caused by the pressure of the fastening ring (23) against the contact area (13, 31) closes the lip valve (15), and wherein the contact area (13) is a bulge of the undeformed nipple flange (12) in which the lip valve (15) is arranged that is pressed flat between the fastening edge (29) and the ring flange (26) when the nipple flange (12) is attached to the bottle (22) by means of a fastening ring (23).

2. The bottle teat according to claim 1, wherein the lip valve (25) is arranged in the nipple flange (12) at a distance from the outer edge of the nipple flange (12).

3. The bottle teat according to claim 1, wherein the lip valve (15) projects from the bottom of the nipple flange (12).

4. The bottle teat according to claim 1, wherein the nipple sleeve (2) has an indentation (21) above the lip valve (15) that points radially toward the nipple flange (12).

5. The bottle teat according to claim 2, wherein the bulge (13) points downward.

6. The bottle teat according to claim 1 that is made of silicone or a thermoplastic elastomer, or another plastic that can be injection molded.

7. The bottle teat according to claim 1 which is injection-molded.

8. The bottle teat having a nipple (1) according claim 1 that is attached to a bottle (22) by means of a fastening ring (23), wherein the fastening ring (23) has fastening means and the bottle (22) has additional fastening means that are connected to each other to fasten the bottle teat (1) to the bottle (22), the ring flange (26) of the fastening ring (23) assumes an area around the nipple sleeve (2) above the nipple flange (12), and the nipple flange (12) is clamped between the fastening edge (29) of the bottle (22) and the ring flange (26) of the fastening ring (23).

9. The bottle teat according to claim 1 that has a plug (33) which seals the drinking hole (10).

10. The bottle teat according to claim 9, wherein the plug (10) is designed as a single part with and from the same material as the remaining bottle teat.

11. The bottle teat according to claim 1, wherein the nipple sleeve (2) has a constriction (11) above the nipple flange.

12. The bottle teat according to claim 11, wherein the lip valve (15.2) is arranged in an area of the nipple sleeve (2) with a larger diameter above the constriction (11).

13. The bottle teat according to claim 12, wherein the lip valve (15.2) is arranged in the area of the nipple sleeve (2) with the maximum diameter (3).

14. A bottle teat for infants and small children comprising:

a nipple sleeve having a hollow nipple (4) with at least one through-hole (10) for liquid nutrition that is connected at the bottom to a hollow nipple sleeve (2) which is connected at the bottom to a substantially annular disc-shaped nipple flange (12) that is connected to the nipple sleeve (2) to be fastened to a fastening edge (29) of a bottle (22) by means of a fastening ring (23) which serves at the bottom with an annular disc-shaped ring flange (26) overlapping the nipple flange (12), a contact area (13, 31) projecting outward from the nipple sleeve (2) above the nipple flange (12) into the area for placing the ring flange (26), a lip valve (15) that is open when the nipple flange (12) is not fastened to said bottle (22) and is arranged in a deforming area next to the contact area (13, 31) so that, when the nipple flange (12) is attached to said bottle (22) by means of said fastening ring (23), the deformation of the nipple flange (12) caused by the pressure of the fastening ring (23) against the contact area (13, 31) closes the lip valve (15), and wherein the lip valve (15) is arranged in the nipples sleeve (2) and the contact area (13) is a bulge of the deformed nipple flange (12) below the lip of the valve (15.2) that is pressed flat between the fastening edge (29) and the ring flange (26) when the nipple flange (12) is attached to a bottle (22) by means of a fastening ring (23).

15. The bottle teat according to claim 14, wherein the lip valve (15.2) extends radially into the nipple sleeve (2) with reference to the nipple flange (12).

16. A bottle teat for infants and small children comprising:

a nipple sleeve having a hollow nipple (4) with at least one through-hole (10) for liquid nutrition that is connected at the bottom to a hollow nipple sleeve (2) which is connected at the bottom to a substantially annular disc-shaped nipple flange (12) that is connected to the nipple sleeve (2) to be fastened to a fastening edge (29) of a bottle (22) by means of a fastening ring (23) which serves at the bottom with an annular disc-shaped ring flange (26) overlapping the nipple flange (12), a contact area (13, 31) projecting outward from the nipple sleeve (2) above the nipple flange (12) into the area for placing the ring flange (26), a lip valve (15) that is open when the nipple flange (12) is not fastened to said bottle (22) and is arranged in a deforming area next to the contact area (13, 31) so that, when the nipple flange (12) is attached to said bottle (22) by means of said fastening ring (23), the deformation of the nipple flange (12) caused by the pressure of the fastening ring (23) against the contact area (13, 31) closes the lip valve (15), and wherein the lip valve (15) is arranged in the nipple sleeve (2), and the contact area (31) is an outward-projecting bead of the nipple sleeve (2) next to the lip valve that is arranged in the area assumed by the ring flange (26) of the fastening ring (23) when the fastening ring (23) fixes the nipple flange (12) to a bottle (22).

* * * * *